United States Patent [19]

Kristensen

[11] Patent Number: 4,886,213

[45] Date of Patent: Dec. 12, 1989

[54] EJECTION NOZZLE FOR HIGH-PRESSURE CLEANING UNITS

[75] Inventor: Olav A. Kristensen, Aarhus, Denmark

[73] Assignee: K.E.W. Industri A/S, Hadsund, Denmark

[21] Appl. No.: 673,856

[22] Filed: Nov. 21, 1984

[30] Foreign Application Priority Data

Nov. 25, 1983 [DK] Denmark ..... 5390-83

[51] Int. Cl.[4] ..... B05B 1/12

[52] U.S. Cl. ..... 239/458; 239/581.2

[58] Field of Search ..... 239/455, 456, 457, 458, 239/579, 581, 581.1, 581.2

[56] References Cited

U.S. PATENT DOCUMENTS

| | | | |
|---|---|---|---|
| 245,096 | 8/1881 | Smith | 239/455 |
| 583,969 | 6/1897 | Askins | 239/455 |
| 1,319,782 | 10/1919 | Maul | 239/581 |
| 3,102,691 | 9/1963 | Gall | 239/458 X |

FOREIGN PATENT DOCUMENTS

| | | | |
|---|---|---|---|
| 590616 | 12/1933 | Fed. Rep. of Germany | 239/458 |

*Primary Examiner*—Andres Kashnikow

*Attorney, Agent, or Firm*—Felfe & Lynch

[57] ABSTRACT

An ejection nozzle for high-pressure cleaning units and having a narrow nozzle opening for high-pressure ejection and having one or more ducts openable through such a large area that low-pressure discharge of a spraying liquid can occur through an end wall of a slidable cylinder jacket portion and having a comparatively wide low-pressure nozzle opening, essentially coaxial with the high-pressure nozzle opening.

4 Claims, 2 Drawing Sheets

EJECTION NOZZLE FOR HIGH-PRESSURE CLEANING UNITS

Figure 1:
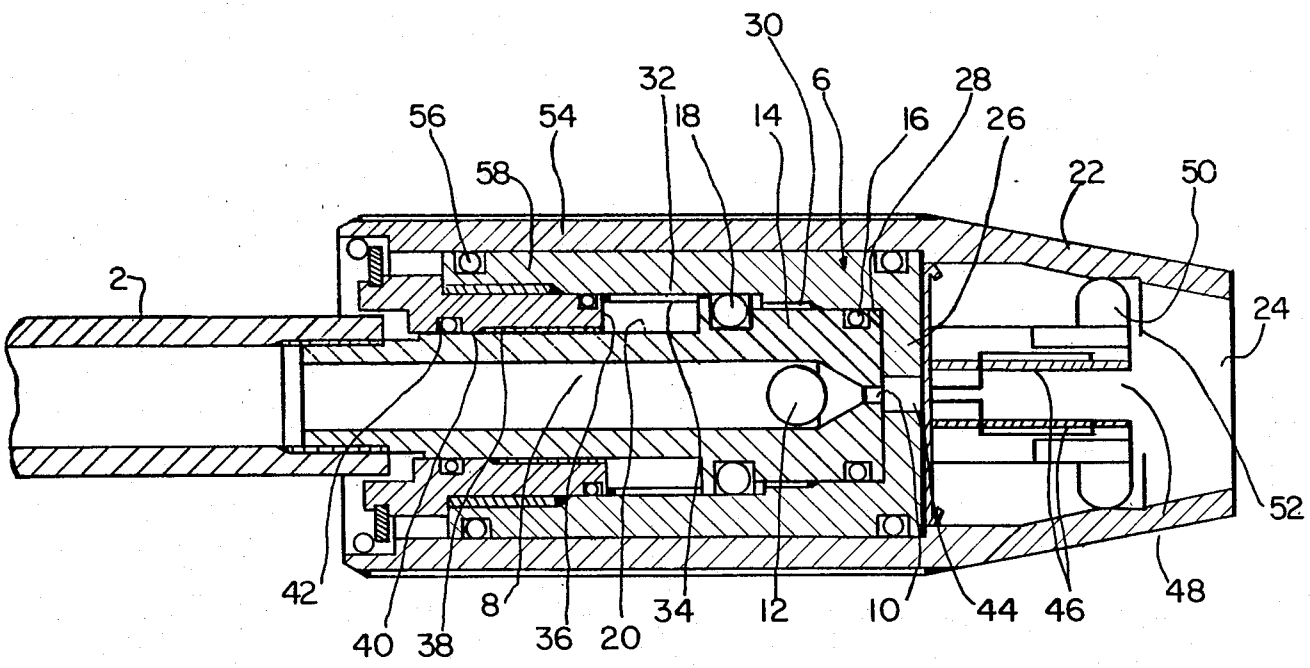

The present invention relates to an ejection nozzle for high-pressure cleaning units or other like apparatus.

Ejection nozzles for high-pressure cleaning units are generally equipped with two different ejection nozzles, viz. a narrow high-pressure nozzle and a more open low-pressure or flushing nozzle. The spray nozzle has an operating valve, e.g. a pistol grip valve, the outlet of which is connected directly with the high-pressure nozzle, while it connects with the low-pressure nozzle through a separate shut-off valve. When the latter is opened, essentially all of the water will be ejected through the low-pressure nozzle, as only an insignificant portion will seep through the high-pressure nozzle, which thus does not have to be blocked in the case of low- pressure ejection.

Frequently, the two nozzles are placed as entirely separate units having separate inlet tubes from the pistol grip valve, but integrated nozzle designs are known. These are ejection nozzles incorporating a shut-off valve for the low-pressure nozzle, so that the entire nozzle unit can be connected with the pistol grip valve by means of one single tube only. The said tube terminates in a duct leading directly to the high-pressure nozzle, from where a wide radial duct branches, said duct discharging into an annular space around and immediately behind the high-pressure nozzle. By means of an external, slideable operating section, this space is openable forwardly into an annular low-pressure nozzle area around the high-pressure nozzle, and the nozzle opening or openings in the annular area are so shaped that in low-pressure operation the water is ejected at the desired dispersion rate. Such a design is expedient in several ways, but another advantage, connected with the use of a separate low-pressure nozzle unit is waived, viz. that at that point the water is focused through an ordinary nozzle hole.

The object of the invention is to provide an ejection nozzle in which the low-pressure water can be ejected simply and expediently through an actual nozzle hole.

According to the invention, this is achieved by the ejection nozzle including a protruding cylinder jacket provided outside the annular area, the cylinder jacket having a terminating end wall at a distance in front of the high-pressure nozzle, the said end wall having a central, comparatively wide low-pressure nozzle opening, essentially coaxial with the high-pressure nozzle. Thus, flow from the said annular space is still relied on, but now no longer in a nozzle-like manner, as water is just supplied to the chamber formed by the said cylinder jacket in front of the high-pressure nozzle, and from where the water is then ejected through the central low-pressure nozzle opening.

The invention is based, inter alia, on the finding that positioning the low-pressure nozzle at some distance in front of or outside the high-pressure nozzle will not disturb its function, even though the high-pressure jet spreads somewhat from the high-pressure nozzle and onwards; the low-pressure nozzle opening is larger than the opening in the high-pressure nozzle, and coaxial positioning of the low-pressure nozzle opening will thus permit the high-pressure jet to pass through this opening quite unobstructedly. Conversely, the low-pressure ejection will not be disturbed by the chamber behind the low-pressure nozzle being in open, backwardly extending communication with the high-pressure nozzle opening, as the full water supply pressure prevails behind it.

Normally, it is desirable that the low-pressure jet, in particular, is ejected in flattened, fan-shaped form, and an immediate result of the invention is that such a shape can be provided in a far simpler way than in the case of low-pressure ejection through an annular nozzle area. In fact, in terms of production it will be very easy to form the central low-pressure nozzle opening with a flattened shape, while shaping an annular ejection area correspondingly in terms of flow or direction is a correspondingly more complex task.

However, the invention allows a particularly advantageous possibility with respect to a desired flattening of the low-pressure jet from a nozzle unit of the combined type under consideration, as the central discharge of the low-pressure jet enables the low-pressure opening to be deformable in a simple way, while in practice it will be extremely difficult to operate with an annular nozzle that can change shape or direction. In practice, it is even possible to use an arrangement known in principle, according to which a couple of parallel lip plates are placed immediately outside the nozzle opening. The external ends of the said lip plates can be set to have a larger or smaller interspacing, whereby the said plates will define a discharge slot, whose thickness will determine the fan angle of the low-pressure jet.

The invention also includes a particularly expedient setting device for the said lip plates, whereby they can be independently set by means of the same operating device used for switching the nozzle unit between high-pressure and low-pressure operation.

Figure 2:
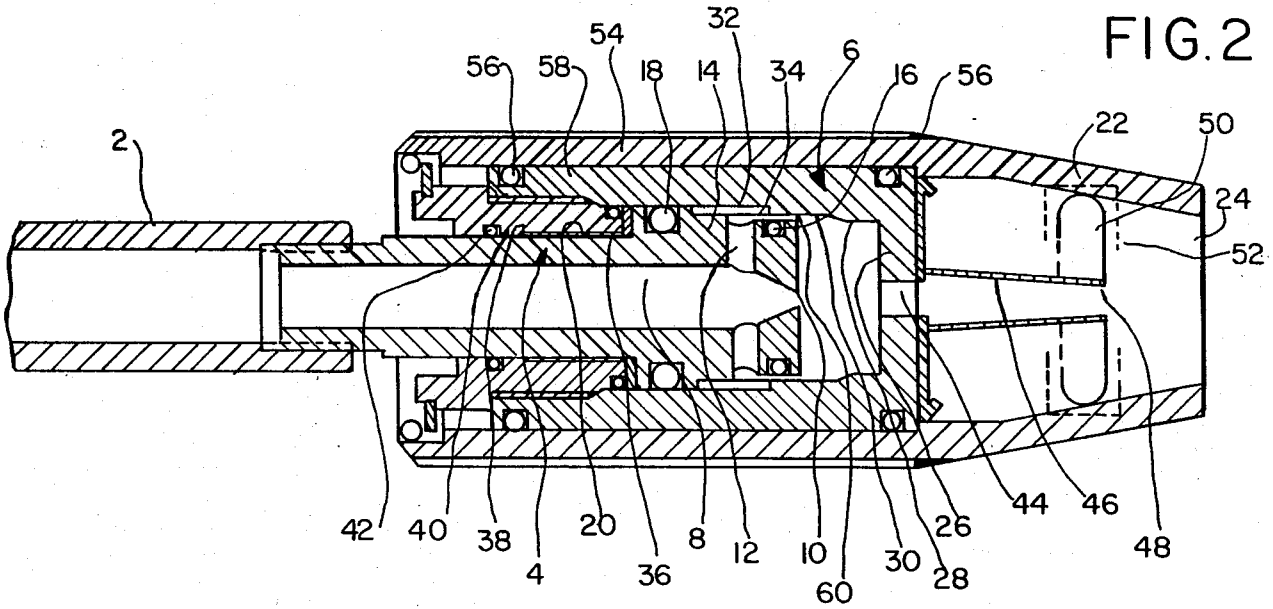

The invention is explained in more detail below with reference to the drawing, on which FIG. 1 is a longitudinal section of a nozzle device according to the invention, while FIG. 2 is a corresponding view of the device shown in another position.

The shown nozzle device is placed at the end of a nozzle tube 2, issuing from a spray grip (not shown) connecting with the discharge hose from a high-pressure cleaning unit and provided with a valve, e.g. a pistol grip valve, for opening and closing the outflow from the tube 2.

The nozzle device consists of two main parts axially slideable in relation to one another, viz. an inner part 4 which is securely connected with the end of the tube 2 and an outer part 6 axially slideable on the inner part 4. The inner part 4 is a tube bushing having a central duct 8, at the free end of the bushing issuing into a constricted nozzle opening 10, with one or more wide radial ducts 12 being provided through the wall of the bushing 4 just before the opening 10.

At its external side, the bushing 4 has at the front a thickened portion 14 with a sealing ring 16 fitted in it. The thickened portion 14 has at its rear end an additional extended annular area, in which there are local depressions for acceptance of steel balls 18. From here, the external side of the bushing extends backwards along a smooth cylindrical surface 20.

The outer part 6 consists of several joined portions, while, however, being axially slideable as unit on the inner part. The exterior of outer part 6 is cylindrical, said part having at its front a constricted orifice cylindrical portion 22 with an external, wide ejection opening 24, permitting unobstructed ejection from the central nozzle 10. Internally, the outer part 6 has a front, inwardly projecting annular flange 26, engaging the front end of the inner bushing 4 in the position shown in FIG. 1. From the said flange, the internal side of the outer part 6 extends backwards in a recticylindrical part 28, which seals against sealing ring 16 and merges into a cylindrical part 30 located behind it, said part 30 having a slightly larger diameter. This part 30 continues backwards in an extended cylindrical part 32, in whose wall lengthwise grooves are provided for accepting the external portions of the balls 18.

The cylindrical part 32 extends slightly backwards to an inwardly projecting shoulder 36, which at the innermost side continues backwards in a cylindrical part 38, whose diameter is slightly larger than the external diameter of the surface part 20. This cylindrical part 38 terminates at its rear in a cylindrical part 40, protruding slightly inwards. The said part sealingly engages the surface 30 of the internal bushing 4 by means of a sealing ring 42 disposed in the part 40. The distance between the cylindrical annular area 30 and the inwardly projecting shoulder 36 is designated x in FIG. 1.

As a result of this distance x, the entire outer part 6 is forwardly slideable to the position shown in FIG. 2, whereby the distance x appears between the front end of the inner bushing 4 and the rear of the annular flange 26 of the outer part. As will be explained below, the outer section 6 is self-supporting in both of the positions under consideration when ejection is performed through the nozzle device.

The central hole in the annular flange 26 in front of the nozzle opening 10 is designated 44. Per se it constitutes a discharge nozzle, in front of which are positioned a couple of forwardly protruding lip plates 46, between their free front ends forming a transverse outflow slot 48. This slot is intended for flattening the ejected jet so as to impart a fan shape to it.

In a preferred embodiment, precisely shown on the drawing, the width of the slot 48 is adjustable, as the lip plates 46 are arranged so as to be elastic inwardly towards each other. At the external side, each plate 46 is connected with a protruding boss via a stabilizing device (not described in more detail), said boss being kept engaged with the internal side of the foremost constricted cylindrical part 22 by an elastic outward pressure from the associated lip plate 46. The annular area 52, in which these engaging points occur, is designed so as to have an eccentricity causing a more or less extensive compression of the front ends of the lip plates 46 by turning the cylindrical portion, whereby the thickness and the fan angle of the ejected fan jet are stepwise adjustable in both of the said positions of the outer part 6. The rotatability of the cylindrical part 22 in relation to the lip plates 46 has been achieved by the part 22 being placed protrudingly from an external cylindrical portion 54 of the outer part 6, as the said cylindrical portion is journalled slightly rotatably by means of friction rings 56 on an internal bushing section 58, which at its front supports the annular flange 26, to which the lip plates 46 are secured. The bushing part 58 is non-rotatably secured to the inner part 4 by means of the said balls 18 and ball grooves 34, so that the entire outer part 6 is slightly axially slideable on the inner part 4, while the outer cylinder 54, 22 is slightly rotatable for settng the slot width 48.

When the outer part 6 is in a retracted position as shown in FIG. 1, the water flows directly to the narrow nozzle opening 10. The water pressure can propagate out through the radial duct 12 to the surrounding annular space between the external side of the bushing part 14 and the internal cylindrical face 30 on the outer part 6, but the sealing ring 16 constitutes a block against forwardly moving discharge of water in this space. The water pressure in the space does have a forwardly actuating effect on the outer part 6, but the pressure acts even more rearwardly pushing, as the pressure also propagates backwards, past the balls 18 and back towards the inwardly protruding shoulder face 36 and onwards into the narrow space between the cylindrical faces 20 and 38 in front of the sealing ring 42, whereby the rearwardly acting pressure acts on a larger pressure area of the outer part than the forwardly-acting pressure. In this way, the nozzle device will be stabilized in a positon in which high-pressure ejection can be achieved through the narrow nozzle 10.

When it is desired to work with low-pressure ejection, the outer part 6 of the nozzle should simply be pushed to its foremost position, shown in FIG. 2. In this position, the foremost sealing ring 16 on the internal bushing 4 is brought out of sealing engagement with the cylindrical face 28, and the extended cylindrical face 30 forms an annular discharge opening 60 together with the front end of the internal bushing 4. Water can flow forwards through the said opening from the space around the radical ducts 12. The total area of the discharge opening 60 is substantially larger than the area of the central nozzle 10 and is also larger than the area of the nozzle opening 44. The water is injected in the space behind the foremost annular flange 26 and from thence it is ejected through nozzle opening 44 and out through the passage between the lip plates 46.

Upon ejection, the water will dynamically cause the outer part 6 to remain in its protruding position, but in other respects the rearwardly-going static pressure will now only act weakly on the outer part, viz. on the narrow, extreme annular area on the shoulder face 36, so that the outer part is stabilized in its foremost position already at the static pressure.

However, a mechanic holding device may be provided for the outer part 6 in either of its opposite positions, e.g. a simple resilient ball lock, for which one of the balls 18 could be utilized, so that no unintentional resetting of the outer part can occur, e.g. while ejection is temporarily closed.

It will be within the scope of the invention to provide the construction in such a way that selection between the two nozzles is achieved by turning an operating part, such as the entire external part, while selection with other operating devices is possible when using adjustable lip plates or corresponding flat nozzle edge portions, e.g. also by using a longitudinal slideability of all or part of the external nozzle portion.

It will also be possible to use the nozzle according to the invention for ejecting pressurized liquid in general, whereby only substantially more liquid will be ejected when opening the annular outlet 60 and the wide nozzle opening 44.

I claim:

1. An ejection nozzle for high-pressure cleaning apparatus, comprising an inlet duct having a terminating narrow opening of a nozzle portion for high-pressure ejection, one or more side ducts branching out from said inlet duct, said one or more side ducts terminating in an annular space around said high-pressure nozzle portion, said space being forwardly open or openable in an annular area through such a large opening area that low-pressure discharge of a spraying liquid can occur, operating means for opening and closing this discharge through said one or more side ducts and said annular space, a protruding slidable cylinder jacket portion being outside the said annular area and having a shoulder face of sufficient area that during high-pressure ejection liquid pressure against said shoulder face is effective to maintain said operating means in position to close said low-pressure discharge through said one or more side ducts to maintain high pressure ejection in the nozzle, said cylinder jacket portion having a terminating end wall at a distance in front of said high-pressure nozzle portion, said end wall having a central, comparatively wide low-pressure nozzle opening, essentially coaxial with said high-pressure nozzle portion, said operating means comprising said cylinder jacket portion, which-by axial sliding-can cause opening and closing of the discharge through said annular area, said cylinder jacket portion being operable in such a way that discharge through said annular area is possible when said low-pressure nozzle opening is located at a maximum distance in front of said high-pressure nozzle portion.

2. An ejection nozzle according to claim 1, which includes a pair of lip plates outside said low-pressure opening for producing a fan-shaped ejection jet.

3. An ejection nozzle according to claim 2, in which said lip plates have extreme front edges and in which the distance between said extreme front edges of said lip plates is adjustable, said cylindrical jacket portion having a forwardly extended constricted portion controllably connected with said lip plates for sliding these into position by moving said cylindrical jacket portion.

4. An ejection nozzle according to claim 3, in which said cylindrical jacket portion is axially slidable for opening and closing the discharge through said annular area and moreover rotatable for setting the distance between said lip plates.

* * * * *